US006921143B2

(12) United States Patent
Hinton et al.

(10) Patent No.: US 6,921,143 B2
(45) Date of Patent: Jul. 26, 2005

(54) MODULAR SWINGING BIN STORAGE SYSTEM

(75) Inventors: Michael Hinton, Chino Hills, CA (US); Ronald Mackert, Woodcrest, CA (US)

(73) Assignee: Metsys, LLC, Chino Hills, CA (US)

( * ) Notice: Subject to any disclaimer, the term of this patent is extended or adjusted under 35 U.S.C. 154(b) by 5 days.

(21) Appl. No.: 10/691,883

(22) Filed: Oct. 22, 2003

(65) Prior Publication Data

US 2004/0140743 A1 Jul. 22, 2004

Related U.S. Application Data

(60) Provisional application No. 60/420,309, filed on Oct. 22, 2002.

(51) Int. Cl.[7] ..... A47B 88/00
(52) U.S. Cl. ..... 312/322; 312/350; 312/332.1
(58) Field of Search ..... 312/307, 321, 312/322, 329, 350, 122, 132, 133, 332.1

(56) References Cited

U.S. PATENT DOCUMENTS 983,885 A * 2/1911 Fitts ..... 312/118
1,082,082 A * 12/1913 Jiranek ..... 108/93
1,083,415 A * 1/1914 Sorensen ..... 312/322
1,406,129 A * 2/1922 Woltz ..... 312/322
1,476,414 A * 12/1923 Ohnstrand ..... 292/173
1,749,937 A * 3/1930 Dettenborn ..... 312/322
2,037,919 A * 4/1936 Burns ..... 108/93
2,815,252 A * 12/1957 Baker ..... 384/23
3,436,768 A * 4/1969 Armin ..... 5/2.1
4,124,262 A * 11/1978 Schill ..... 312/305
4,125,305 A * 11/1978 Kasindorf ..... 312/332.1
4,738,495 A * 4/1988 Mitts ..... 312/305
4,959,582 A * 9/1990 Meyer et al. ..... 312/307
5,671,987 A * 9/1997 Hommes ..... 312/334.23
5,813,735 A * 9/1998 Wu ..... 312/204
6,076,904 A * 6/2000 Shepherd et al. ..... 312/209
6,113,201 A * 9/2000 Bauer ..... 312/245

* cited by examiner

*Primary Examiner*—Janet M. Wilkens
(74) *Attorney, Agent, or Firm*—Christie, Parker & Hale, LLP

(57) ABSTRACT

A swinging bin storage system is disclosed. The system has a cabinet with an open front, with an upper track and a lower track adjacent to its open front, and bins located within the cabinet portion. Each bin has a pivot that permit the bin to laterally slide in the upper track and lower track and pivot out of the cabinet when a user wishes to open the cabinet, and a handle on a front wall of the bin, which handle activates a catch which is adapted to releasably slide within one of the upper and lower tracks of the cabinet.

34 Claims, 15 Drawing Sheets

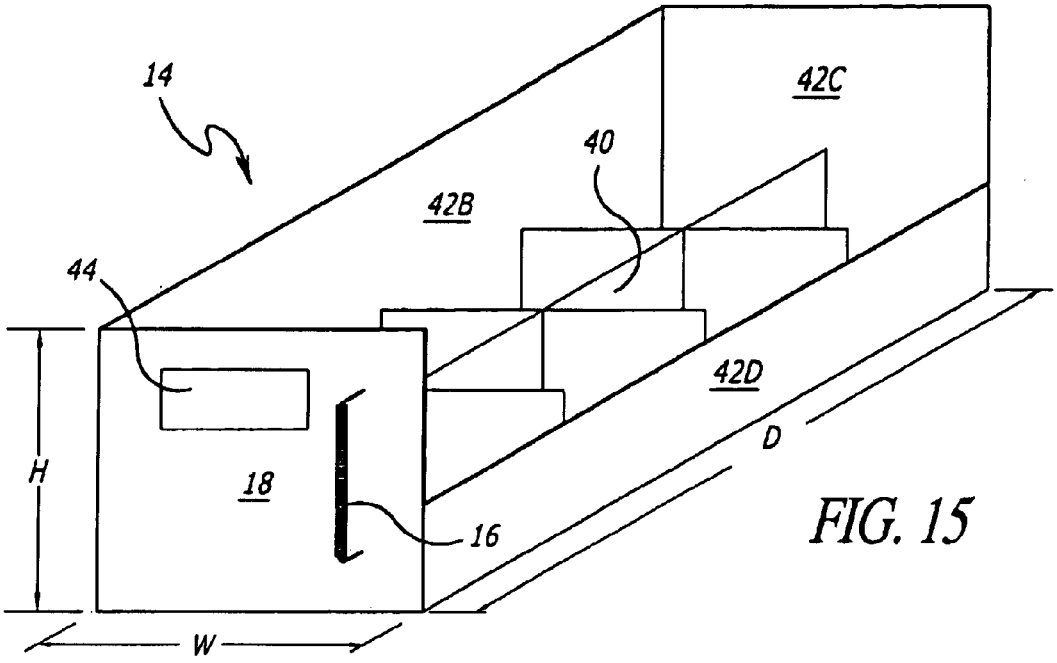
FIG. 15
FIG. 16A
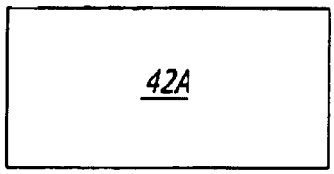
FIG. 16F
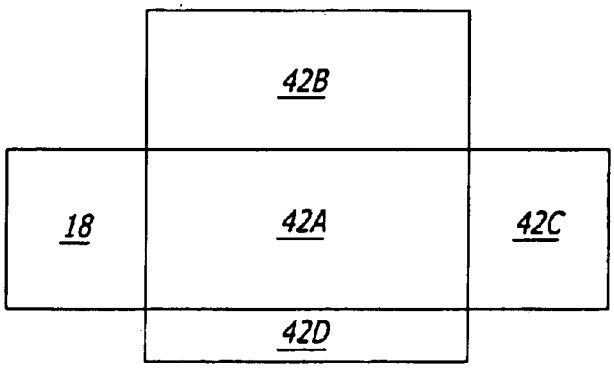
FIG. 16B
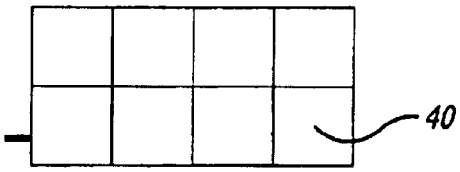
FIG. 16C
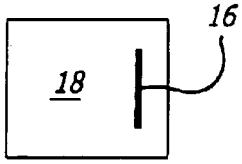
FIG. 16D
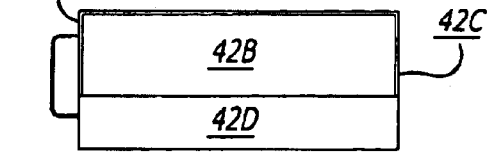
FIG. 16E
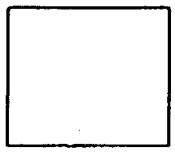

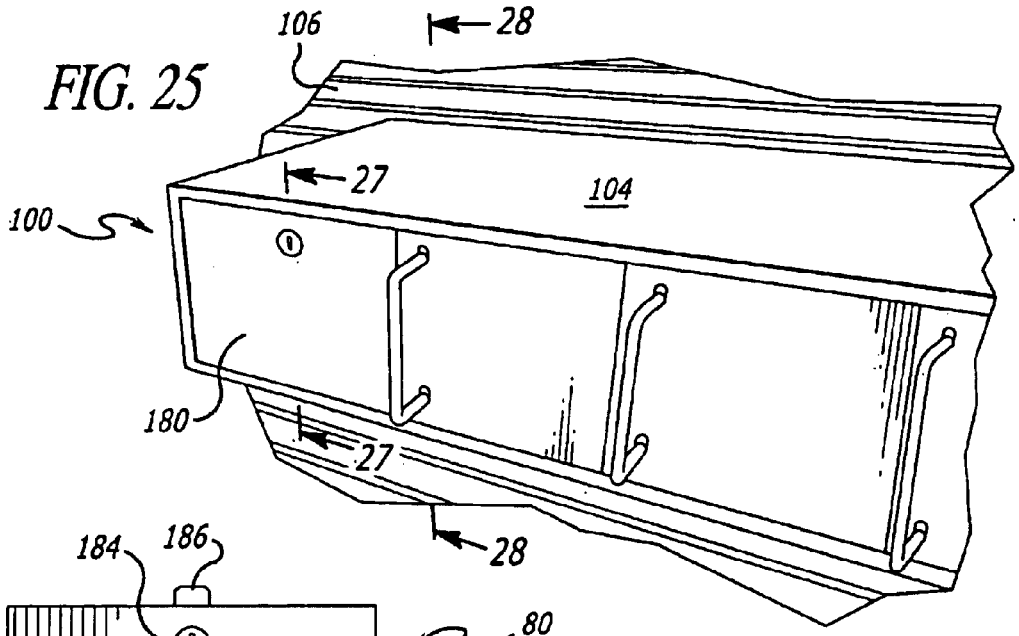
FIG. 25
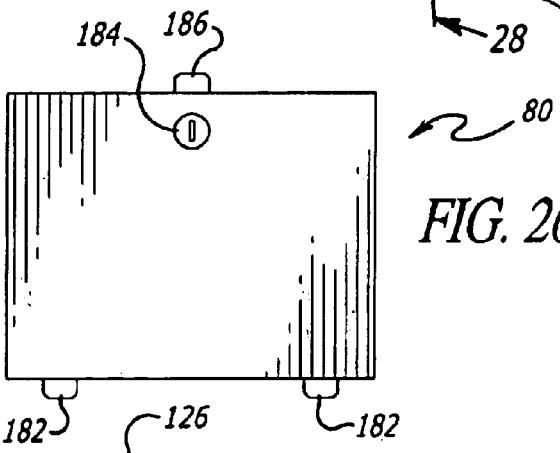
FIG. 26
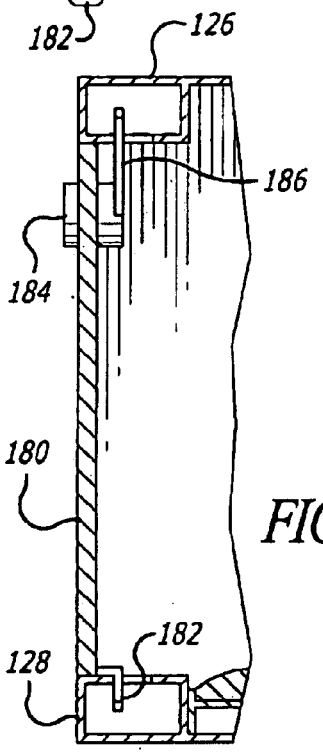
FIG. 27
FIG. 28
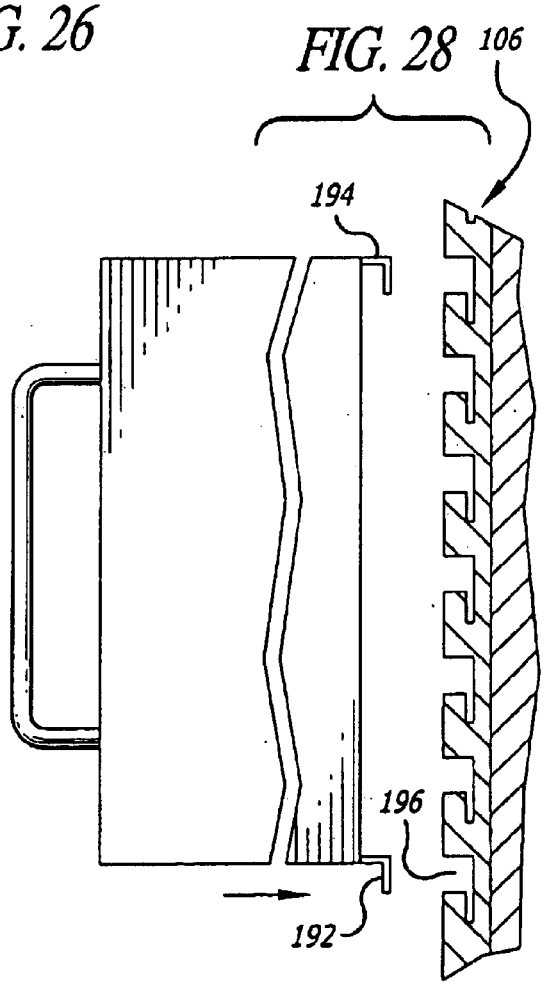

MODULAR SWINGING BIN STORAGE SYSTEM

CROSS-REFERENCE TO RELATED APPLICATIONS

This application claims the benefit of provisional patent application Ser. No. 60/420,309, filed Oct. 22, 2002, for the application entitled "MODULAR SWINGING BIN STORAGE SYSTEM."

BACKGROUND OF THE INVENTION

The invention is related to the field of storage systems, and more particularly to a modular swinging bin storage system.

Presently, retail storage of products takes place on shelving, in bins, hangers, or in drawers. Quantities of multiple items can be stored, or quantities of individual items can be stored. Some continuing issues with storage of large numbers of individual items or access to the item include limitations on the fixture size and capacity, the amount of available floor space, proximity issues, and/or security needs.

When storing an item on a shelf, a space is often provided above the item for access to the goods. Also, if the shelves are made too deep, or there are too many items stacked one in front of the other, this makes it difficult to easily access items. Thus, capacity for shelves per wall space tends to be low. In the case of drawer storage systems, space should be allocated in front of the drawer in closed position to allow for the drawer to be pulled out in a level and stable manner. If the drawer is not properly designed, some appreciable rear portion of the drawer may remain in the cabinet and items contained therein may be difficult to see. Of course, when a drawer is pulled out into an aisle or area where people are walking or working, this can create work flow issues.

In certain high volume settings, such as retail pharmacies, a large number of prescriptions must be quickly processed. Because of security and privacy issues, after prescriptions are filled, they should be placed out of sight from customers in a secure location that should be quickly accessible by the pharmacists. In many pharmacies, this location is shelving located behind a barrier wall away from customers. In many cases, the amount of room available to store these filled prescriptions is very limited and is not suitable for drawer storage since aisle width is limited.

There accordingly is a need for an improved storage system that maximizes storage volume in a limited floor space, does not unduly disrupt work flow in the vicinity of the storage system, permits quick, easy and full access to items stored therein, and provides for secure storage of the items.

SUMMARY OF THE INVENTION

The invention provides a novel means of storing large quantities of individual items in a space-efficient manner having drawers or bins that swing out from a bin module to provide easy access to items stored in the bins.

The invention further uses a series of bin boxes or drawers with a divider system that are slideably placed side-by-side inside a stackable module or drawer box. The stackable module and the number of and width of the bin boxes are set such that when an entire series of bin boxes are placed in the stackable module, there will remain an access space to permit a bin to be moved from side-to-side in the stackable module. Access to each bin box is facilitated by sliding at least one bin so that the access space is adjacent to a bin box a user wishes to access, and then swinging out the desired bin box from the stackable module. The bin boxes have one front side edge that is both slideably retained in a glide track at a front of the stackable module and providing a pivot axis along which the bin box can be swung out from the stackable module.

Each bin box can have its own pivot axis independent from other bin boxes, or one or more pairs of bin boxes can be hinged together along their pivot axis with a sliding hinge device being seated in the glide track for greater stability. Pairs of adjacent bin boxes can also be hinged together at a back edge thereof to provide for a double bin, center swing embodiment of the invention.

BRIEF DESCRIPTION OF THE DRAWINGS

FIG. 15 is an isometric view showing a schematic view of a bin of the invention with a divider located thereon.

FIGS. 16A–16F show various views of the bin of FIG. 15.

FIG. 25 is a front perspective showing the exemplary sliding and swinging bin storage system of FIG. 18 being supported on a slat wall support system.

FIG. 26 is a front perspective view of an exemplary locking access panel used to close a free access space of the cabinet.

FIG. 27 is a view along view lines 27—27 of FIG. 25 showing the exemplary locking access panel being located in an opening of the cabinet.

FIG. 28 is a partial cross-sectional view along view lines 28—28 of FIG. 25 showing an exemplary manner in which an exemplary sliding and swinging bin storage system can be retained on an exemplary slat wall support system.

DETAILED DESCRIPTION OF THE INVENTION

Figure 1:
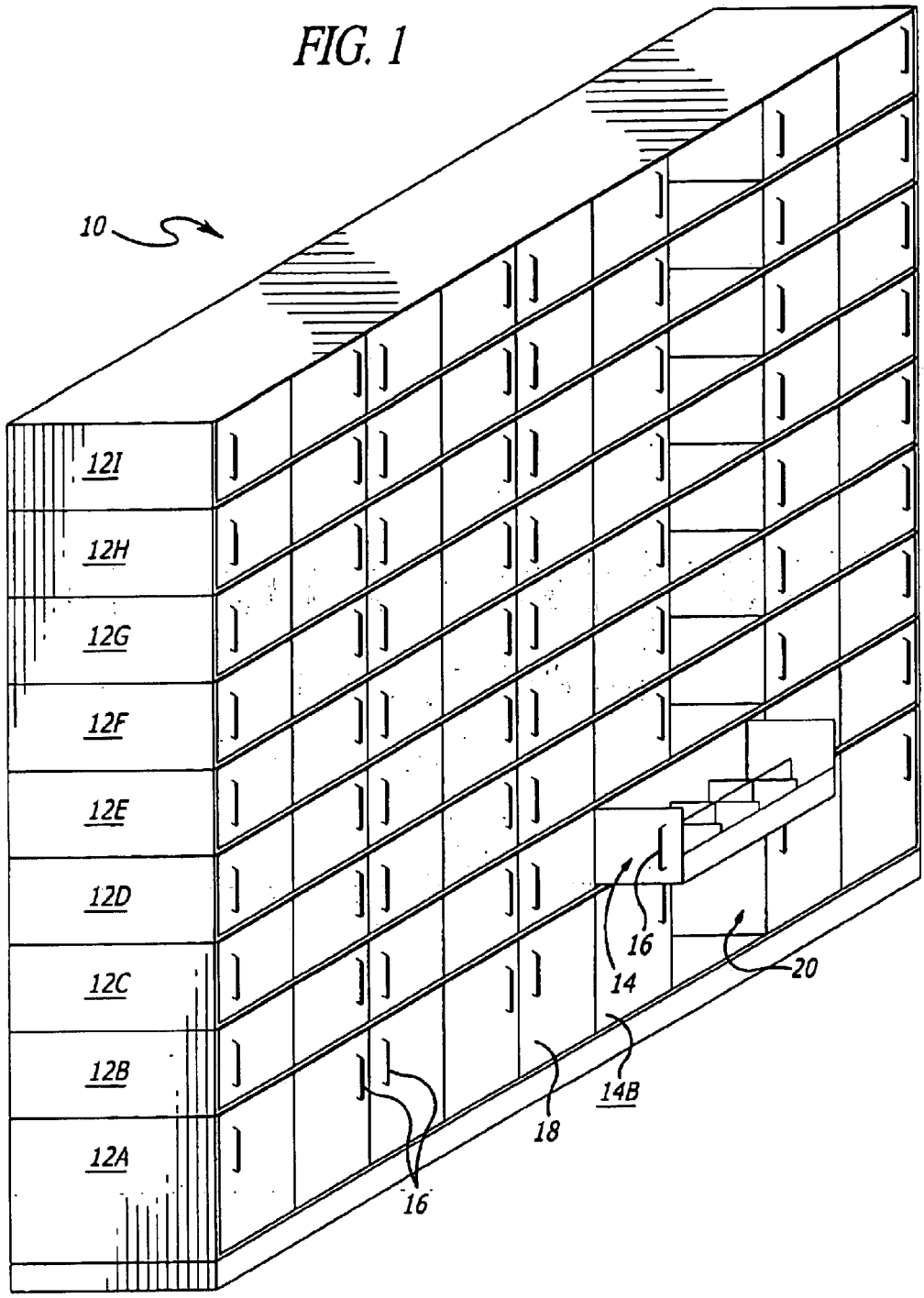
FIG. 1 is an isometric and schematic view of an exemplary bay unit of the invention having multiple bin modules stacked together, with a single bin opened up.

FIG. 1 is an isometric and schematic view of an exemplary bay unit 10 of the invention having multiple bin modules 12A–I stacked together, with a single bin 14 opened up to provide for full access to the interior of bin 14. Each bin has a pull handle 16 located on a front face 18 thereon. Each bin module 12A–I has an unoccupied gap area 20. Gap area 20 is at least as wide as the front face 18 of each bin 14. Near the front, top and bottom inside edges of each bin module, there are located tracks (not shown.) Each bin 14 is slideably positioned inside its respective bin module and can be slid from side-to-side therein, which thereby permits gap area 20 to be shifted. For example, if bin 14B is shifted to the right, it will then occupy the space of gap area 20 and gap area will now be shifted to the area where bin 14B formerly was positioned. Bin modules can be placed on a base frame 22. Uprights can be attached to base frame 22 to create structural integrity and strength for the bay unit. Although not shown, each bin module can have a locking panel that can be used to close or block access to gap area to thereby prevent unauthorized access to the bins. The locking panel can be a panel that extends from one of the side walls of the bin module or can be of another design.

Figure 2:
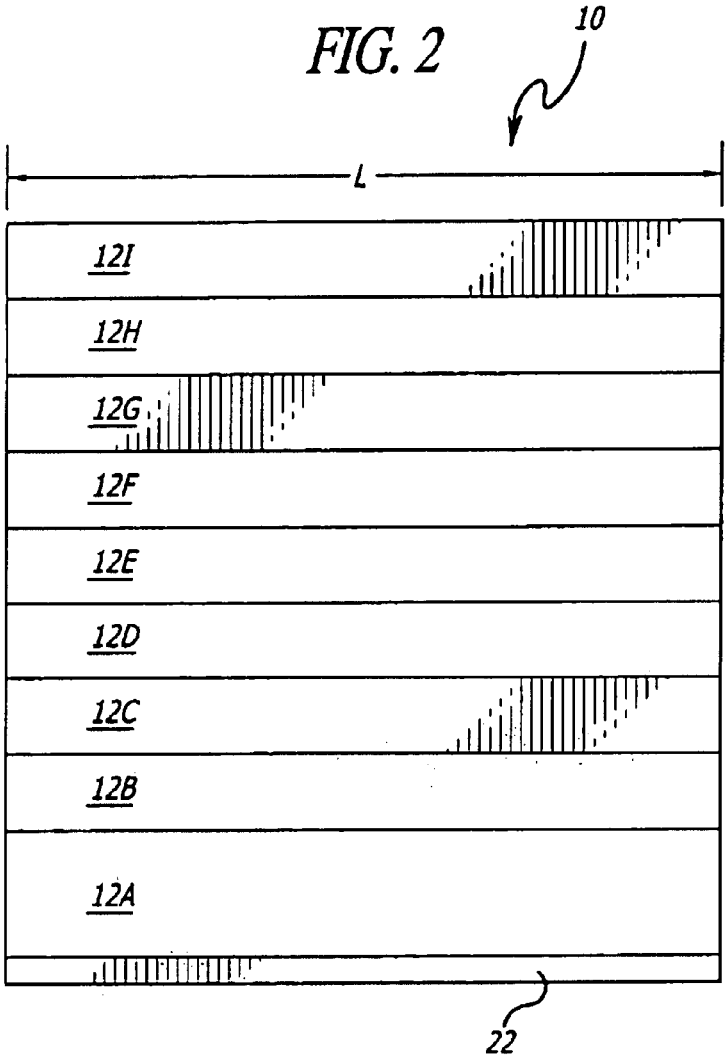
FIG. 2 is a front schematic view of the exemplary bay unit 10 of FIG. 1.

FIG. 2 is a front schematic view of the exemplary bay unit 10 of FIG. 1 and shows the plurality of bay modules 12A–I stacked together. Each bay module has a length L, a depth D, and a height H. Bay unit 10 can have base frame 22 and optionally uprights to which each module can be attached (not shown.) Although 9 modules are shown stacked together, a greater or lesser number of modules can be stacked together depending upon the needs and requirements. Also, the dimensions of each bin can be selected as desired, with extra high bins being provided for larger or taller items to be placed therein. Multiple gangs of bay units can also be connected together.

Figure 3:
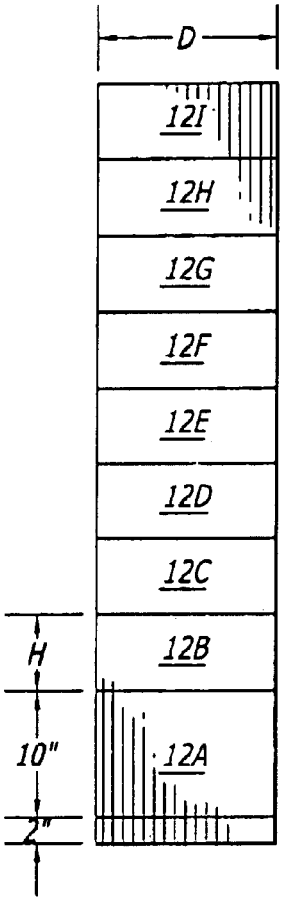
FIG. 3 is a side schematic view of the exemplary bay unit of FIG. 1.

FIG. 3 is a side schematic view of the exemplary bay unit 10 and its plurality of bay modules 12A–I stacked together.

Figure 4:
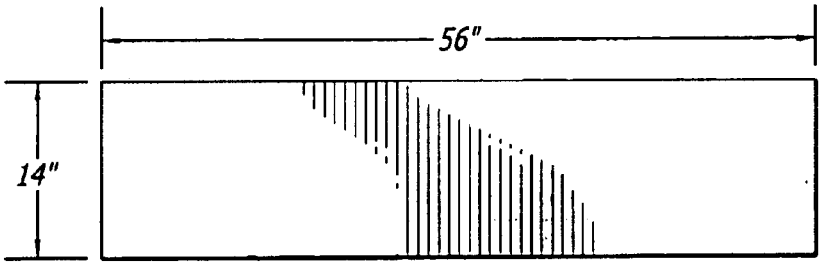
FIG. 4 is a top plan schematic view of the exemplary bay unit of FIG. 1.
Figure 5A:
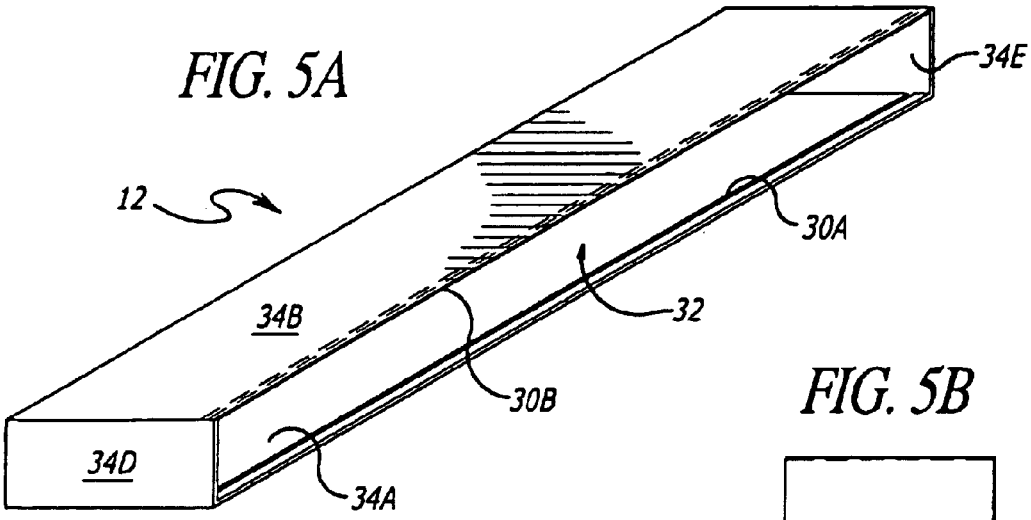
FIGS. 5A–E are various schematic views of an exemplary bin module.
Figure 5B:
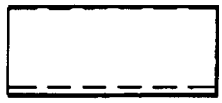
Figure 5C:
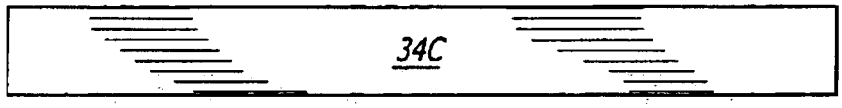
Figure 5D:
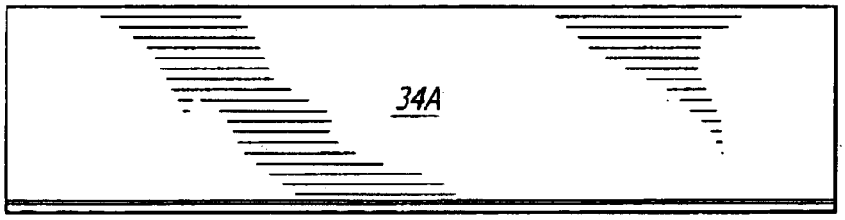
Figure 5E:
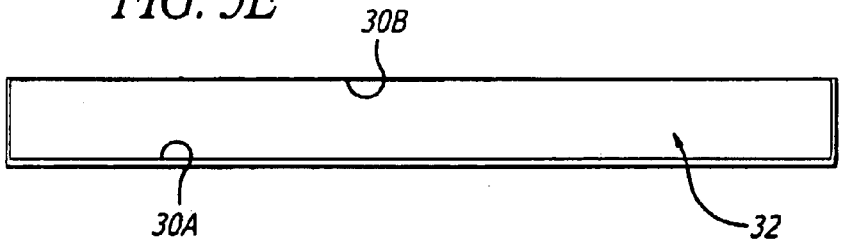

FIG. 4 is a top plan schematic view of the exemplary bay unit 10 of FIG. 1.

FIGS. 5A–E are various schematic views of an exemplary bin module 12. Each bin module 12 has an upper and lower glide track 30A and 30B located adjacent to an open front 32 of bin module 12. Glide tracks 30A and 30B are preferably recessed within the top and bottom walls 34A and 34B, respectively, or each bin module 12. Each bin has a back wall 34C and side walls 34D and 34E. Bin modules are preferably formed of metal, such as steel or aluminum, but can be formed of other material if desired.

Figure 6:
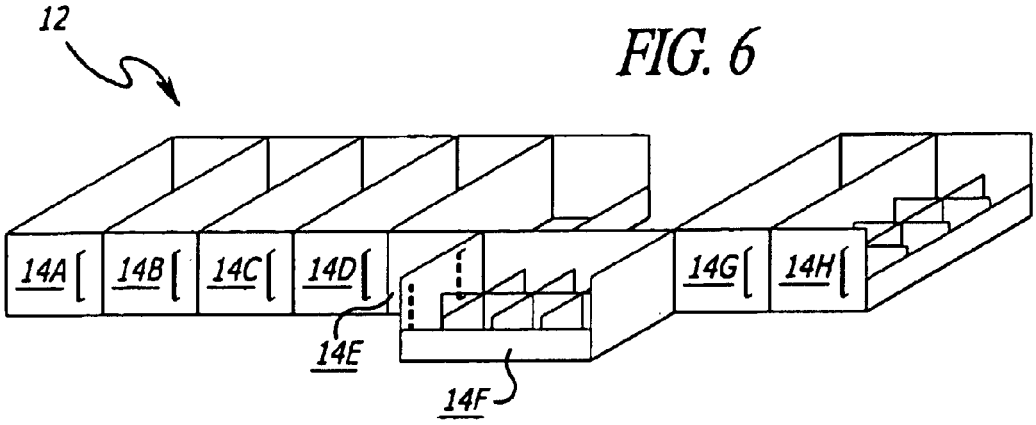
FIG. 6 is an isometric and schematic view of a plurality of single bins in a single bin, side swing embodiment of the invention without the bin module being shown.

FIG. 6 is an isometric and schematic view of a plurality of single bins 14A–H in a single bin, side swing embodiment of the invention 12 without the bin module being shown, and with bin 14F being swung open.

Turning to FIGS. 15 and 16A–16F, there are shown various views of bin 14 of the invention. FIG. 15 is an isometric view of bin 14 with an optional divider 40 located therein, to divide bin into a desired number of spaces of desired size and configurations. If desired, each space can be numbered or otherwise identified. Divider 40 is useful in dividing up space within bin 14 to permit efficient storage in a separated manner of items placed therein. Bin 14 has a bottom wall 42A, a back wall 42B, a side wall 42C which is opposite front face 18, and a front wall 42D. Front wall 42D is preferably shorter than back wall 42A to allow easier access to bin. Bin can have a label holder 44 on its front face 18 to hold a label. Bin 14 can be formed from a single sheet of metal by bending as required, as shown in FIG. 16F. Bin can also be formed of high strength plastic if desired.

Figure 7:
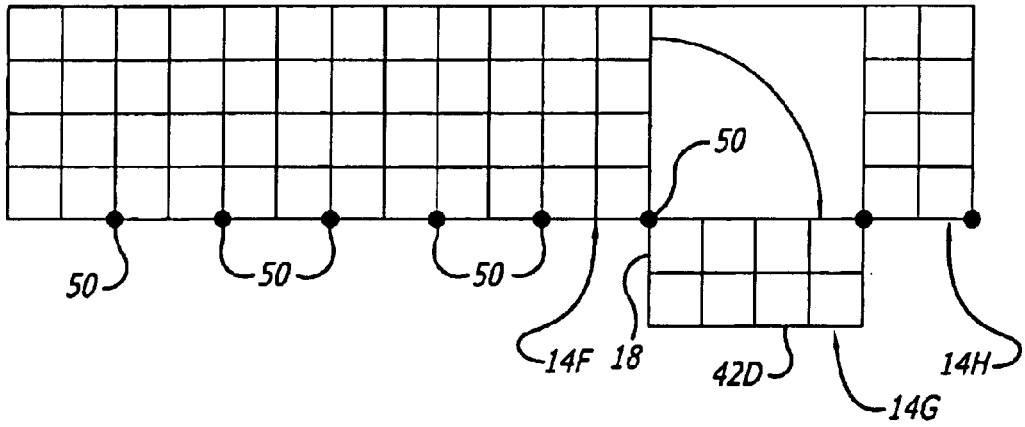
FIG. 7 is a schematic top view showing how a single bin in a single bin, side swing embodiment of the invention is opened up.

FIG. 7 is a schematic top view showing how a single bin 14G in a single bin, side swing embodiment 12 of the invention is opened up. Near one of a left or right front corners of a bin glide and pivot means 50 is provided which not only permits each bin to slide relative to glide tracks 30A and 30B, but also pivots out and in from bin module 12 such that the front face 18 with its handle 16, which formerly faced out, is now facing to a left (or right) side of bin module and is out of bin module and front wall 42D is facing out, with back wall 42B now generally blocking a portion of open front of bin module.

Figure 8A:
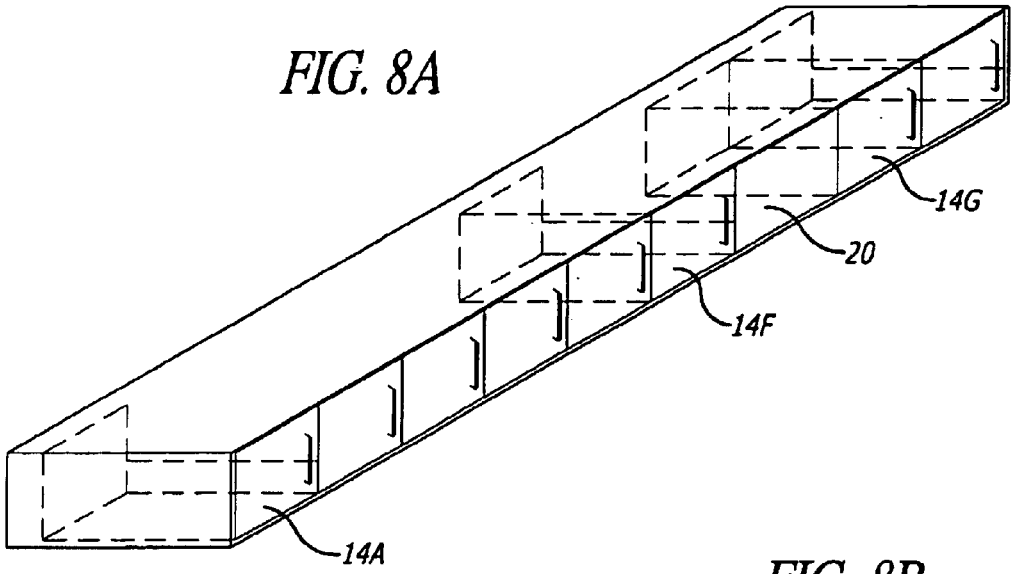
FIG. 8A is an isometric and partially exposed view showing single bins in the single bin, side swing embodiment of the invention in the bin module.

FIG. 8A is an isometric and partially exposed view showing single bins in the single bin, side swing embodiment 12 of the invention in the bin module. As can be seen, when in the closed position, bins 14 are located in bin module in a side-by-side manner with their longer dimension positioned within bin module, and with gap area 20 adjacent to one or two of bins.

Figure 8B:
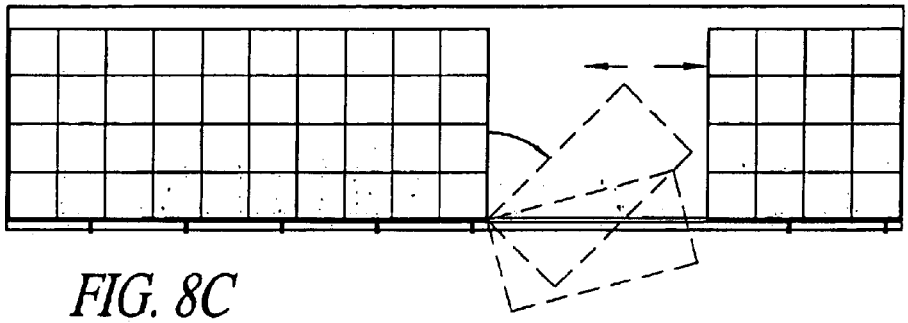
FIGS. 8B–D are schematic top views showing how a single bin in the single bin, side swing embodiment of the invention is swung to its open position.
Figure 8C:
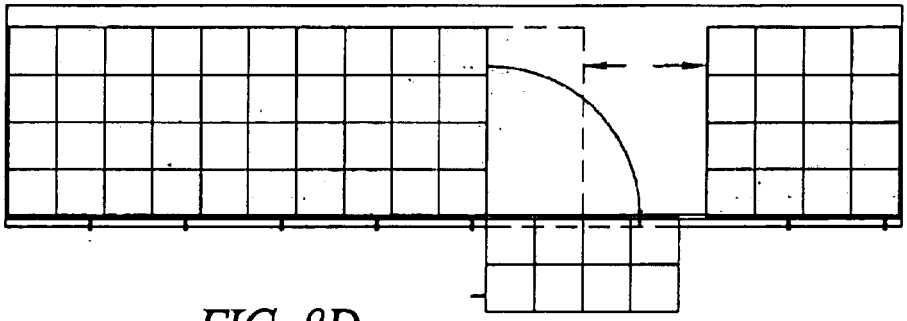
Figure 8D:
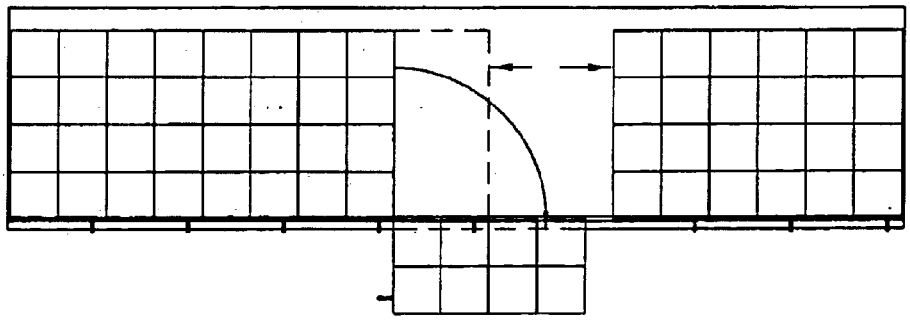
Figure 17:
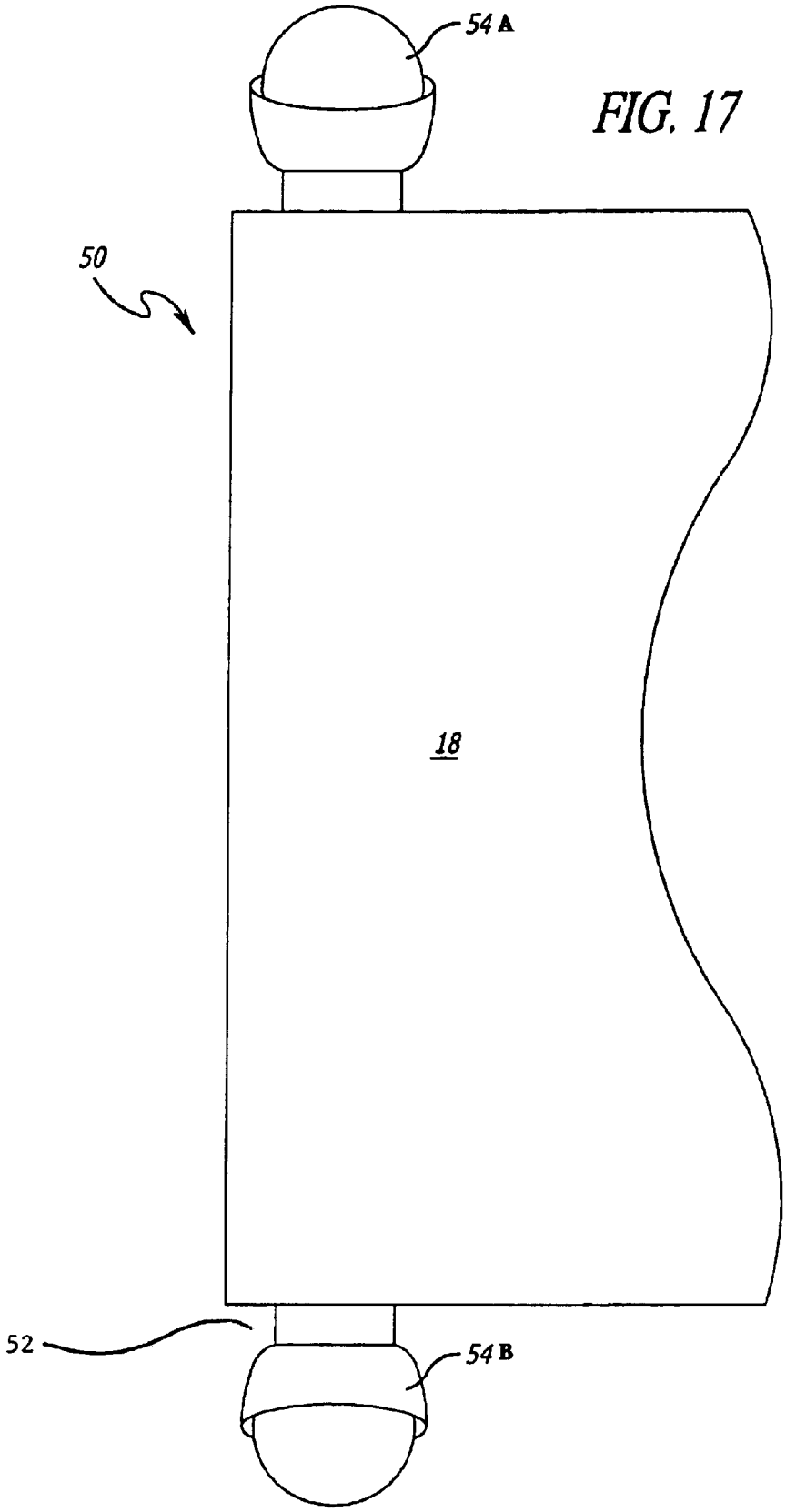
FIG. 17 is a schematic view of a gliding hinge of the invention.

FIGS. 8B–D are schematic top views showing how a single bin in the single bin, side swing embodiment of the invention 12 is swung to its open position. As noted above, a bin glide and pivot means 50 is fitted near one of a left and right corner of bin near front face 18 of bin. Bin glide and pivot means 50 or sliding hinge, can comprise a vertical rod 52 with roller bearings 54A and 54B on its top and bottom, respectively, and one exemplary embodiment of same is shown in FIG. 17. Bin glide and pivot means 50 or sliding hinge permits bin to not only slide within glide tracks 30A and 30B, but also to pivot. Other designs can be used and should provide functionality by providing a gliding movement and a pivoting movement around the pivot.

Turning back to FIGS. 8B–D, when a user pulls on handle 16, this causes bin to swing out from front opening of bin module about the bin glide and pivot means 50. If the bin a user wishes to open is adjacent to gap area 20 opposite the slide hinge side of bin, the user will simply pull on handle 16, which will cause the bin to swing out of bin module. If the bin a user wishes to open is not adjacent to gap area 20, then the user can slide one or more bins to place gap opening so that it is adjacent to gap area 20 opposite the slide hinge side of bin to be opened. The user will then proceed to swing out the desired bin. Also, it is possible that the action of swinging out a desired bin will push on other bins, and cause them to shift to provide the gap area where it is required. The process of moving bins from side-to-side and even of swinging open a bin to be accessed can be automated with various motive means, if desired, and can be computer controlled to either completely open a bin or perhaps partially "pop open" a bin to be opened.

Figure 9A:
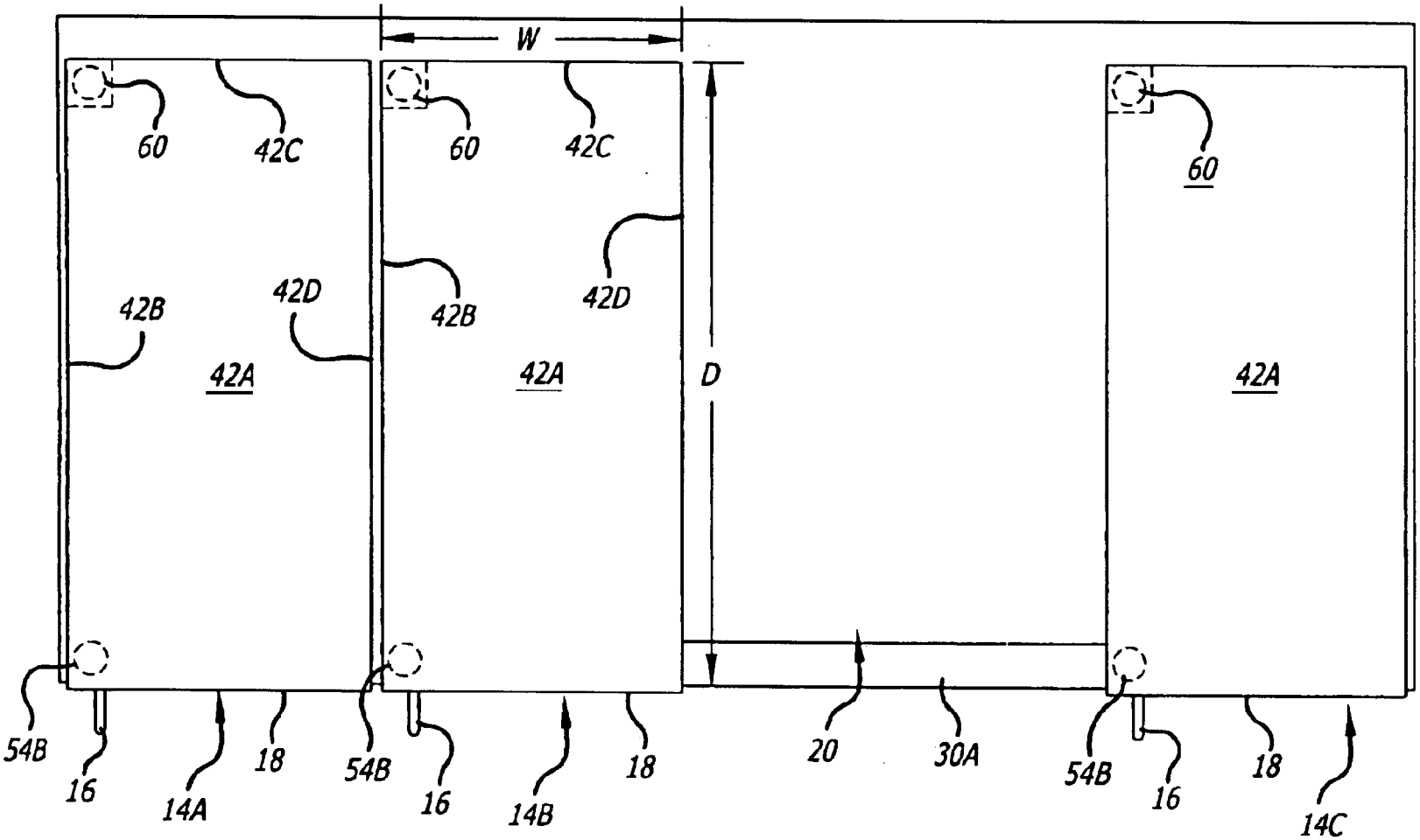
FIGS. 9A–9C are schematic top plan views showing how a single bin in the single bin, side swing embodiment of the invention is swung to its open position.
Figure 9B:
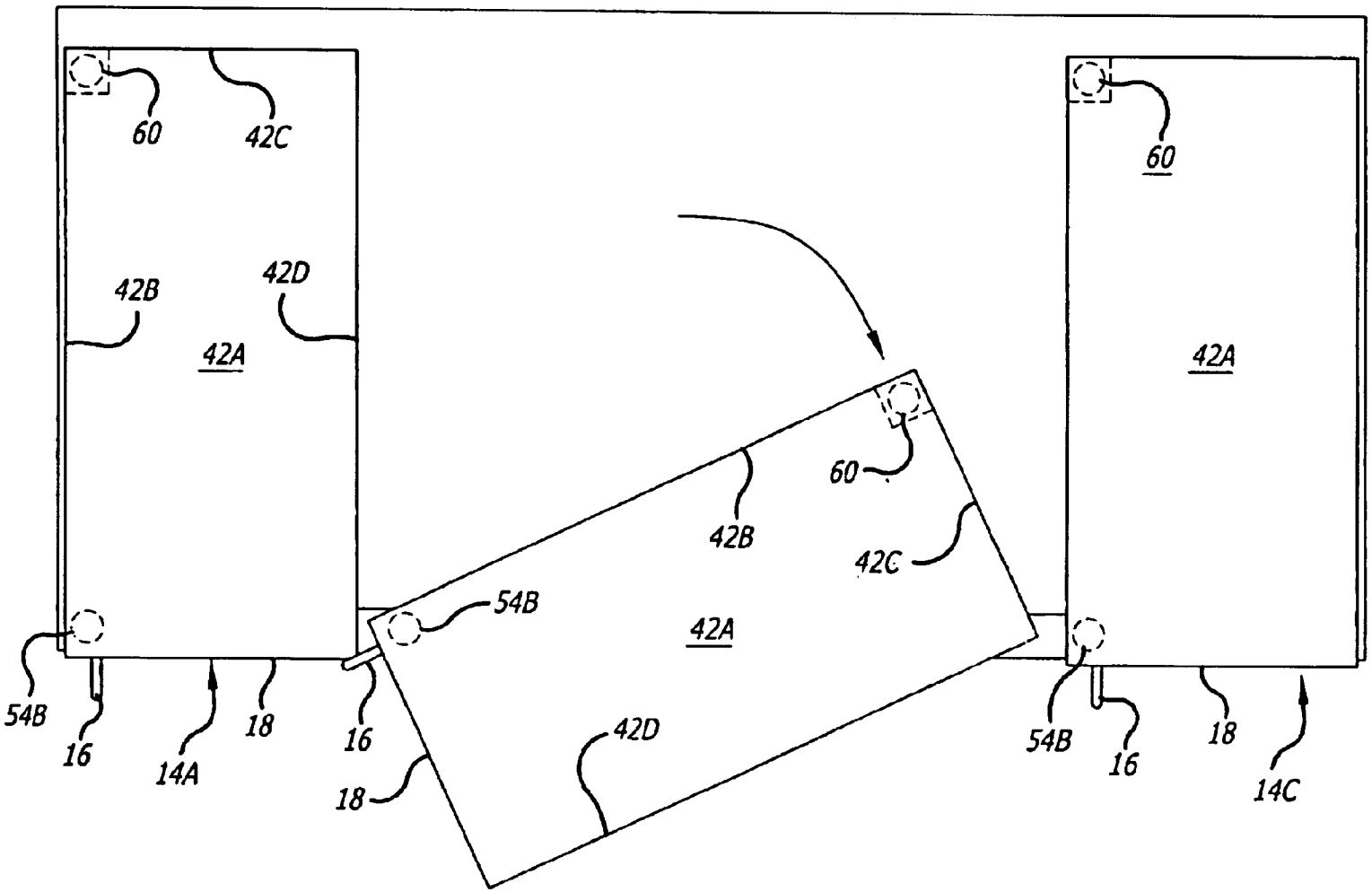
Figure 9C:
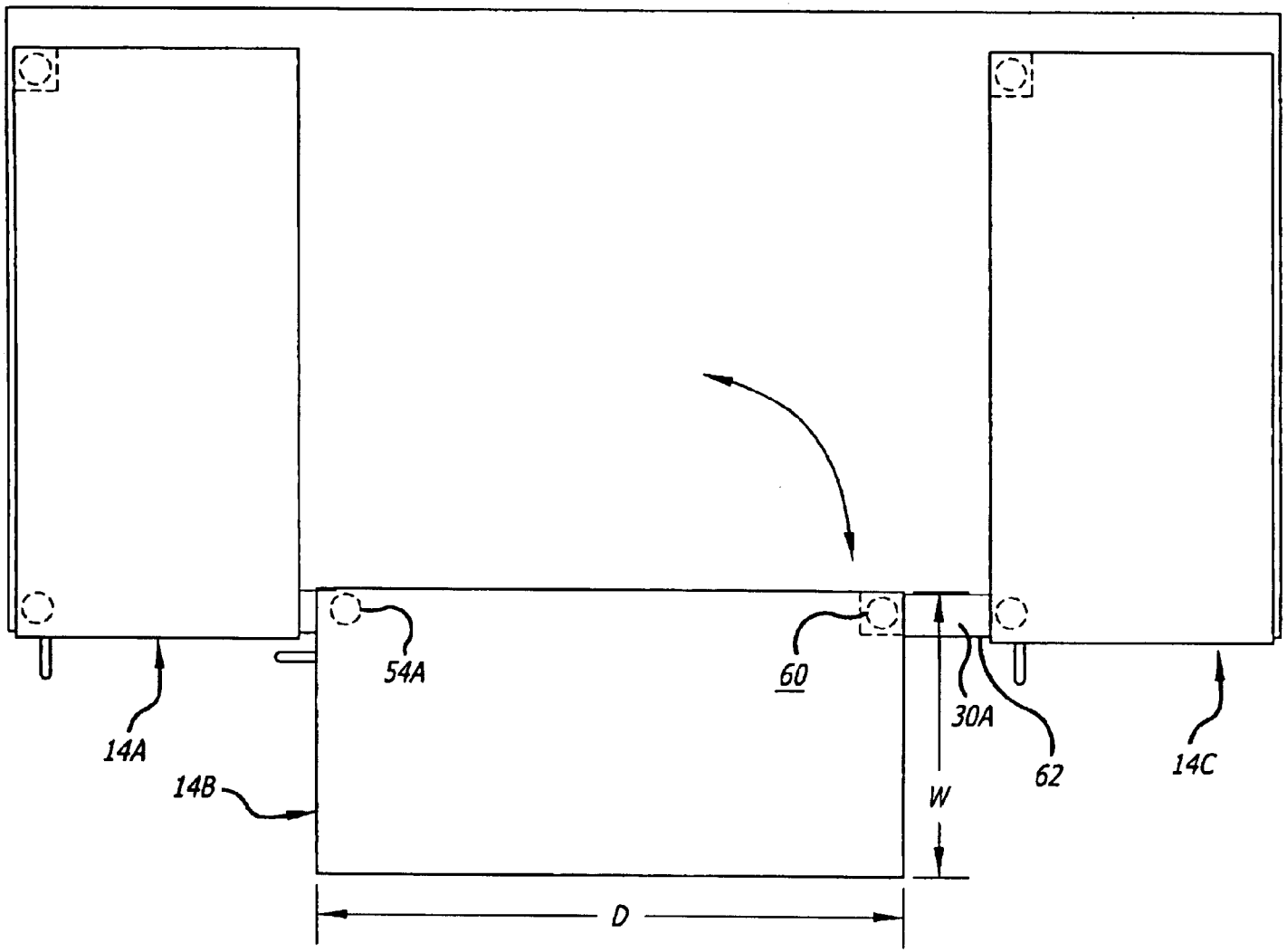

FIGS. 9A–9C are schematic top plan views showing how a single bin in the single bin, side swing embodiment of the invention is swung to its open position, with top of bin module being removed to show bins contained therein. FIG. 9A shows three bins 14A, 14B and 14C in bin module 12, with gap area 20 moved between bins 14B and 14C. The top of roller bearing 54B is shown. A moveable support means 60, such as a caster 60 is preferably located on a bottom wall 42A of bins, and will support bins at its bottom near its side wall 42C. Moveable support means 60 is located opposite bin glide and pivot means 50 adjacent to rear wall 42B and has its roller bearings 54A and 54B located in tracks 30A and 30B, respectively, and with sufficiently tight tolerances such that bin will not unduly wobble within tracks and bin module.

FIG. 9B shows bin 14B in the process of being swung out of bin module. Bin 14B pivots around its bin glide and pivot means 50 in tracks 30A and 30B, and moveable support means 60 supports bin at its rear and rides on floor 34A of bin module. FIG. 9C shows bin 14B after it is completely opened. In its opened position, caster 60 drops into lower glide track 30A. Lower glide track has a barrier (e.g. such as a barrier wall 62 at its front) which prevents bin from being pulled too much and prevents caster 60 from being withdrawn from lower glide track 30A and thus prevents bin 14 from being pulled out too far out of bin module. Due to the 90 degree rotation of bin from its stored position of FIG. 9A to its opened orientation of FIG. 9C, in the position of FIG. 9C, a user can fully access items contained in bin since no portion of the bin remains inaccessible within bin module. Furthermore, in the opened position, since the width "W" of bin is less than the depth "D" of bin, bin will extend out of bin module by its width "W" rather than its depth "D", which would be the case if bins were on regular drawer sliders and pulled straight out. In general, gap opening 20 needs to be as wide as the diagonal length from the pivot point 54 to the opposite corner of bin so that as bin is being swung open, its corner swinging nearest the bin adjacent to gap opening 20 will clear this bin adjacent to gap opening.

Figure 10:
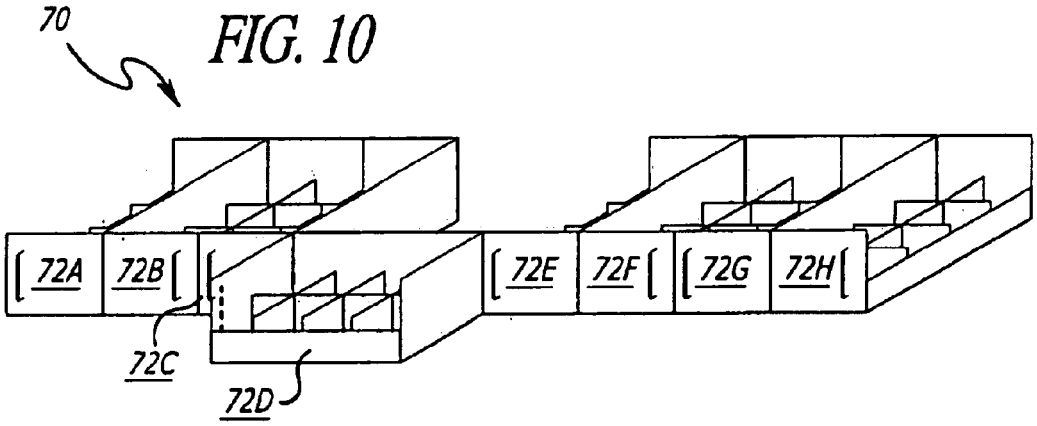
FIG. 10 is an isometric and schematic view of a plurality of double bins in a double bin, side swing embodiment of the invention without the bin module being shown.

FIG. 10 is an isometric and schematic view of a plurality of double bins in a double bin of the invention without the bin module being shown. In the double bin embodiment, pairs of adjacent bins are hinged together (e.g. 72A and 72B, 72C and 72D, 72E and 72F and 72G and 72H) at their front faces 18 such that when one bin (e.g. bin 72D) is swung out from bin module, bin 72C will help carry some of the suspended weight of bin 72C and its contents. In the case of the double bin, side swing embodiment 70, a bin glide and pivot means 50 is located between the two adjacent bins 72C and 72D and is hinged to both. In this embodiment, adjacent pairs of hinged together bins have their handles 16 attached to their bin faces and are on opposite sides of the front faces thereof, and hinged together bins are arranged in a back-to-back manner, such that swinging out one of each pair will expose the bin being accessed.

Figure 11:
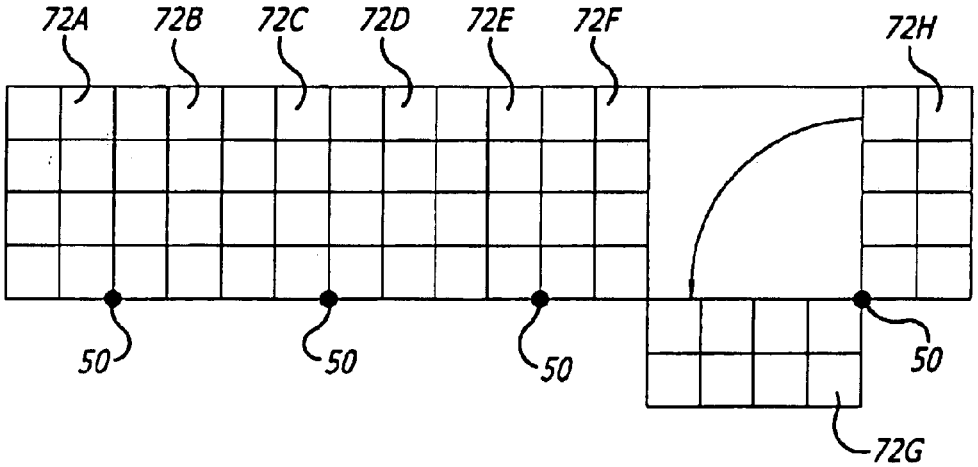
FIG. 11 is a schematic top view showing how a double bin in a double bin, side swing embodiment of the invention is opened up.
Figure 11:
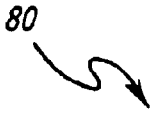

FIG. 11 is a schematic top view showing how the double bins in the double bin, side swing embodiment of the invention 70 is opened up. Bin glide and pivot means 50 is located between the two adjacent bins 72G and 72H and is hinged to both. The same goes with other adjacent pairs of bins 72A and 72B, 72C and 72D, and 72E and 72F.

Figure 12A:
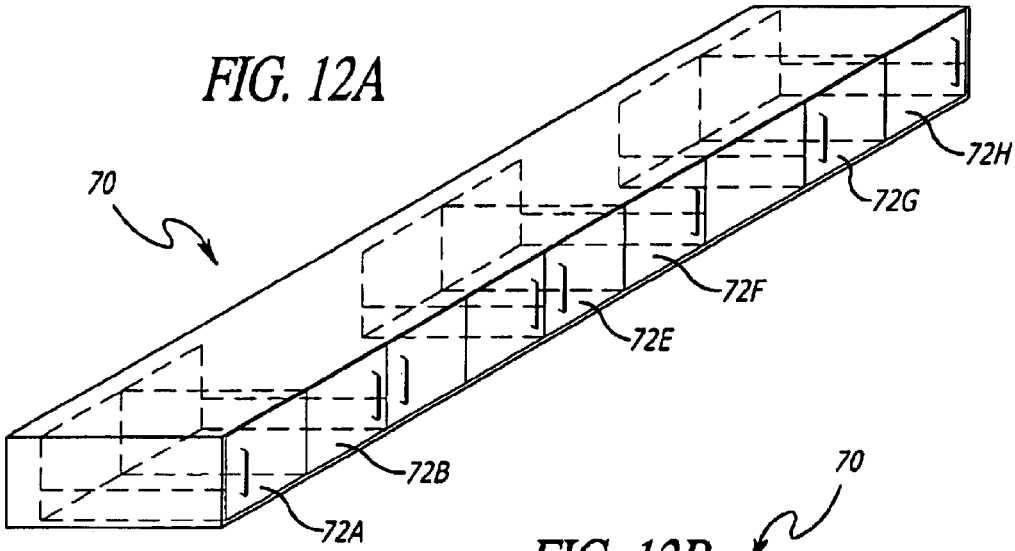
FIG. 12A is an isometric and partially exposed view showing double bins in the double bin, side swing embodiment of the invention in the bin module.

FIG. 12A is an isometric and partially exposed view showing double bins in the double bin, side swing embodiment of the invention 70 in the bin module.

Figure 12B:
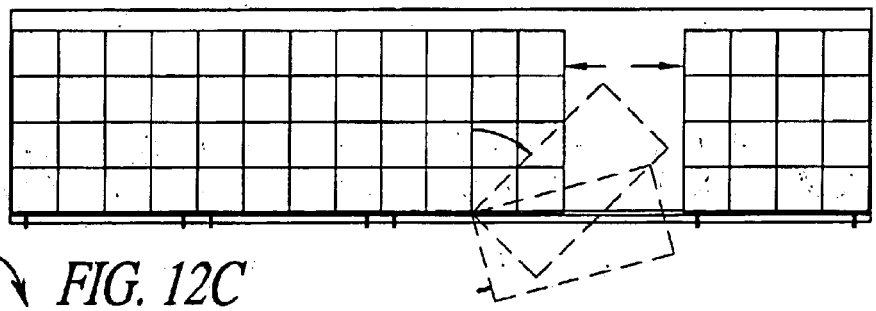
FIGS. 12B–D are schematic top views showing how a double bin in the double bin, side swing embodiment of the invention is swung to its open position.
Figure 12C:
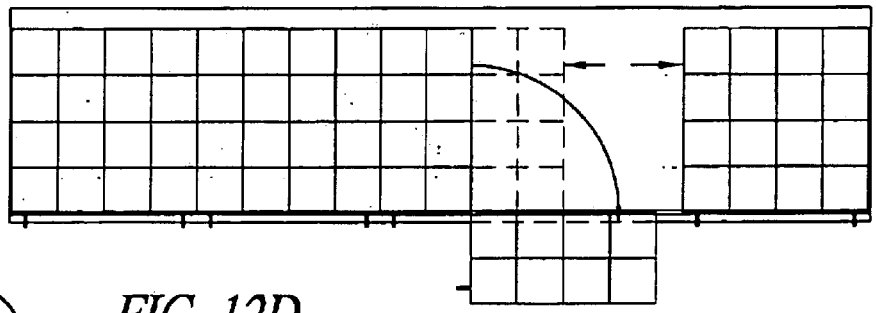
Figure 12D:
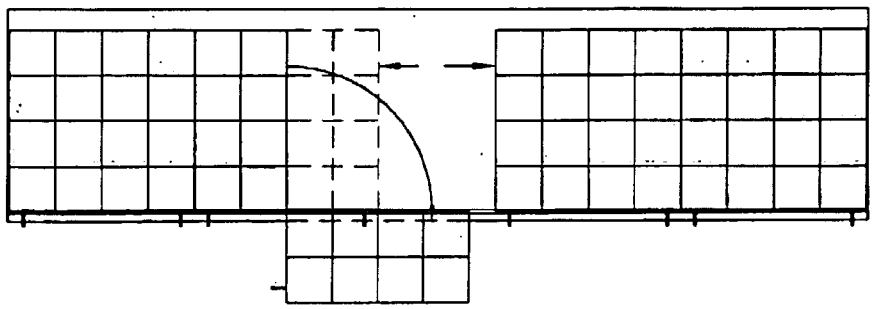

FIGS. 12B–D are schematic top views showing how a double bin in the double bin, side swing embodiment of the invention 70 is swung to its open position. As can be appreciated by examining FIGS. 12B–D, in its opened position, the weight of the opened bin is partially carried by the bin to which it is hinged, which unopened but hingedly attached bin will partially carry the weight of the opened bin and may help in preventing the opened bin from exerting excessive torque on its bin glide and pivot means, and help carry the weight of the opened bin and any items located therein. Gap opening 20 can be moved if there is a need to access a desired bin.

Figure 13:
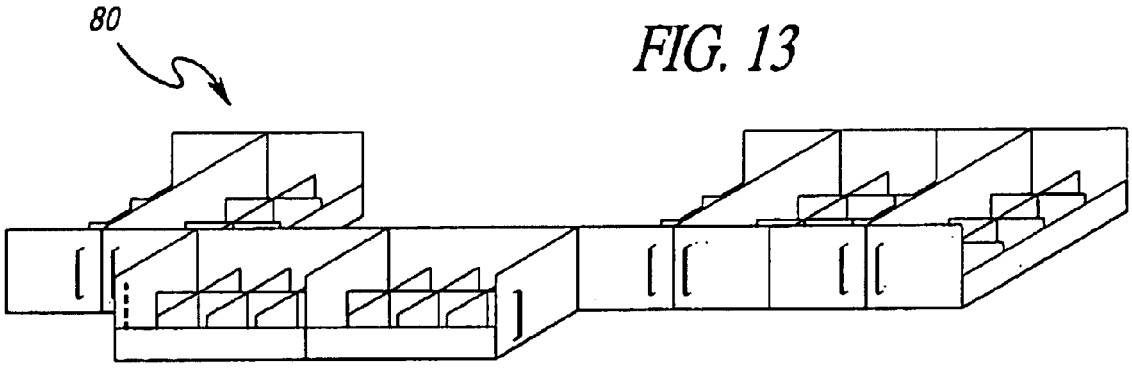
FIG. 13 is an isometric view of a plurality of double bins in a double bin, center swing embodiment of the invention without the bin module being shown.

FIG. 13 is an isometric view of a plurality of double bins in a double bin, center swing embodiment of the invention 80 without the bin module being shown.

Figure 14:
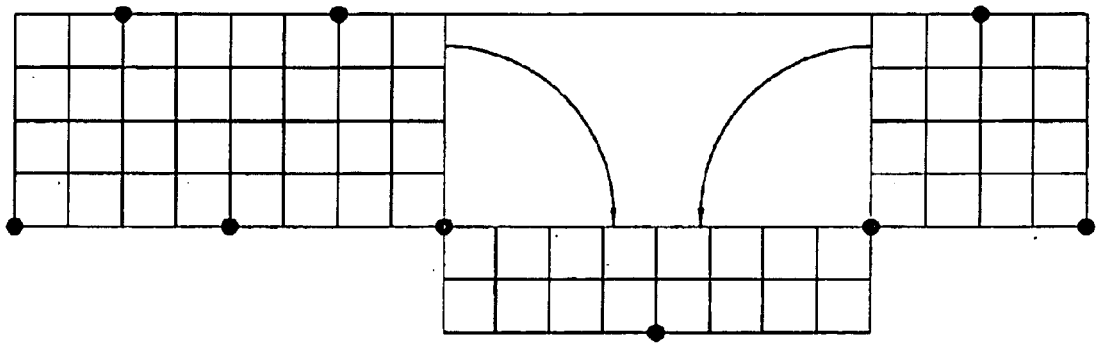
FIG. 14 is a schematic top view showing how a double bin in a double bin, center swing embodiment of the invention is opened up.

FIG. 14 is a schematic top view showing how the double bins in a double bin, center swing embodiment of the invention 80 is opened up. This embodiment is similar to that of the second embodiment, except that adjacent bins are hinged together alternately at their front and rear walls in an "accordion" fashion, instead of having just pairs of bins hinged together. The hinges 82 at the front of the bin module can be associated with the bin glide and pivot means 50. The hinges connecting together backs of alternating adjacent bins are not connected to any bin glide means. In this embodiment, instead of a single bin opening up, two bins must be opened up. Since two bins open up in this embodiment, in the closed position, the gap area will need to be larger to accommodate two bins being hinged in at the same time.

Figure 18:
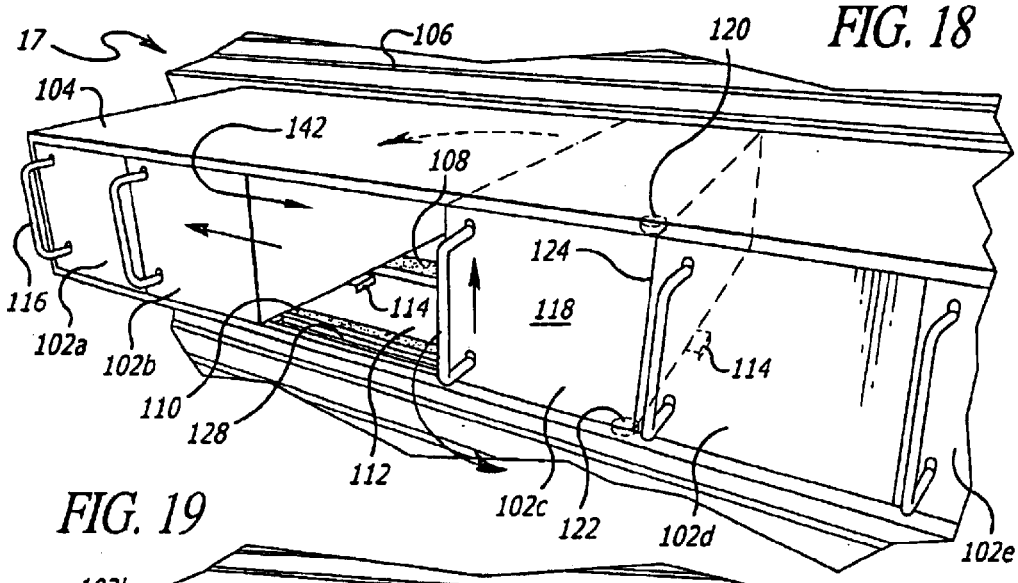
FIG. 18 is a front perspective view of another exemplary embodiment of a sliding and swinging bin storage system of the invention with the bins in their closed positions.
Figures 21, 22, 23, 24:
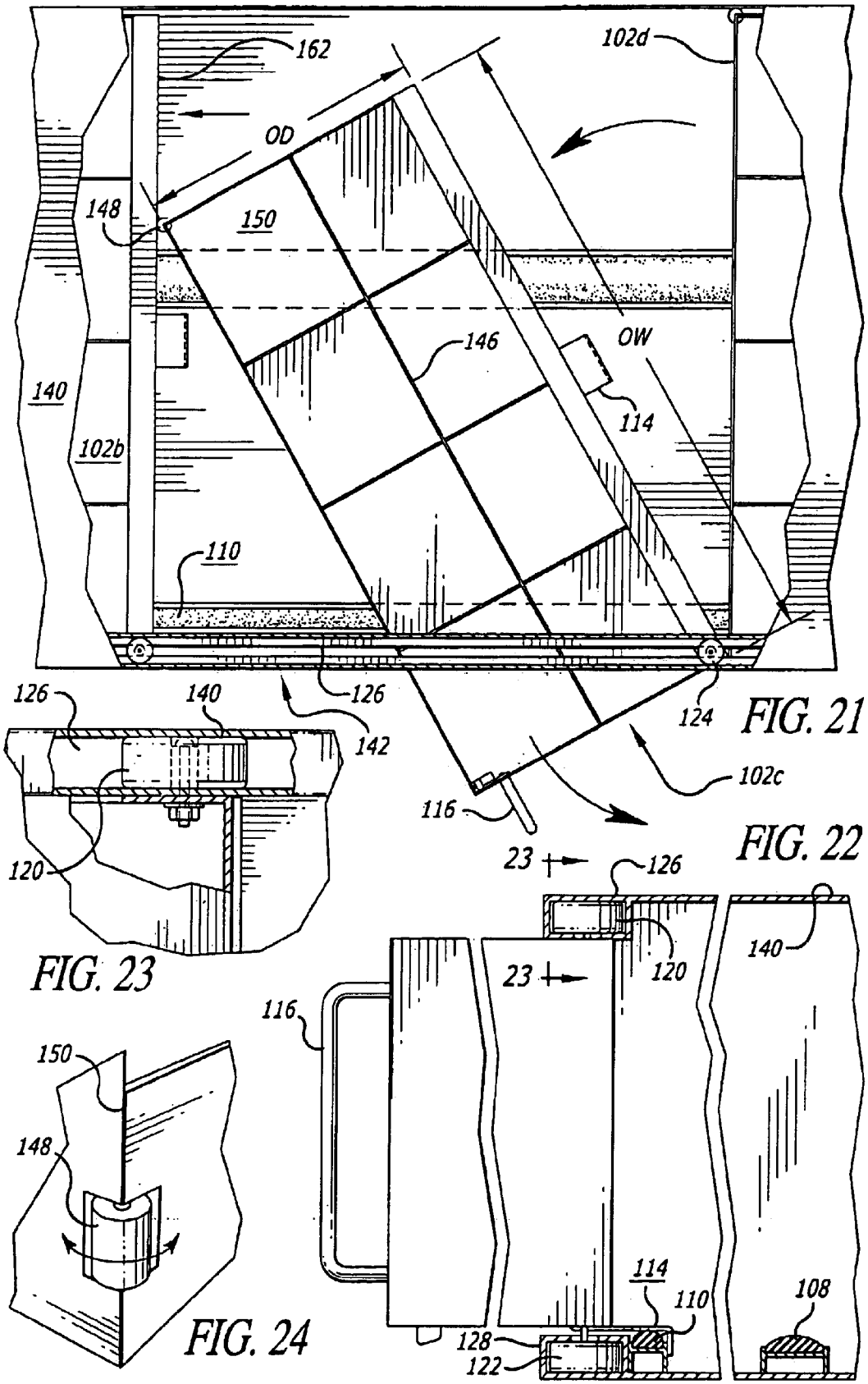
FIG. 21 is a partially exposed top plan view of an exemplary bin being swung out of its cabinet.
FIG. 22 is a partially exposed side view showing an exemplary bin being pivoted out of its cabinet.
FIG. 23 is a detail along view lines 23—23 of FIG. 2 of the upper roller of the bin being retained in an upper track of its cabinet.
FIG. 24 is a detail showing a corner roller of an exemplary bin.

FIG. 18 is a front perspective view of another exemplary embodiment of a sliding and swinging bin storage system 100 of the invention with bins 102*a*, 102*b*, 102*c*, 102*d* and 102*e* in their closed positions and slideably retained in a cabinet 104, which is supported on a slat wall 106. Cabinet 104 can have glide surface 108 and optionally glide surface 110 on a bottom surface 112 thereof. A catch 114 can be located on a bottom of each bin (see also FIG. 21.) Each bin has a handle 116 located on a front face 118 of each bin. Each bin has an upper pivot roller 120 and a lower pivot roller 122 located near a front pivot corner 124 of each bin. Upper pivot roller 120 is slideably positioned in an upper track (see upper track 126 in FIGS. 21–23 shown) and a lower pivot roller 122 is slideably and rotatably moveable in lower track 128 (see also FIG. 22.) Cabinet 104 has an upper wall surface 140 which carries upper track 126. Bins 102*b* and 102*c* are shown separated by an open space 142 therebetween. Bins have an open width "OW" and an open depth "OD".

Figure 19:
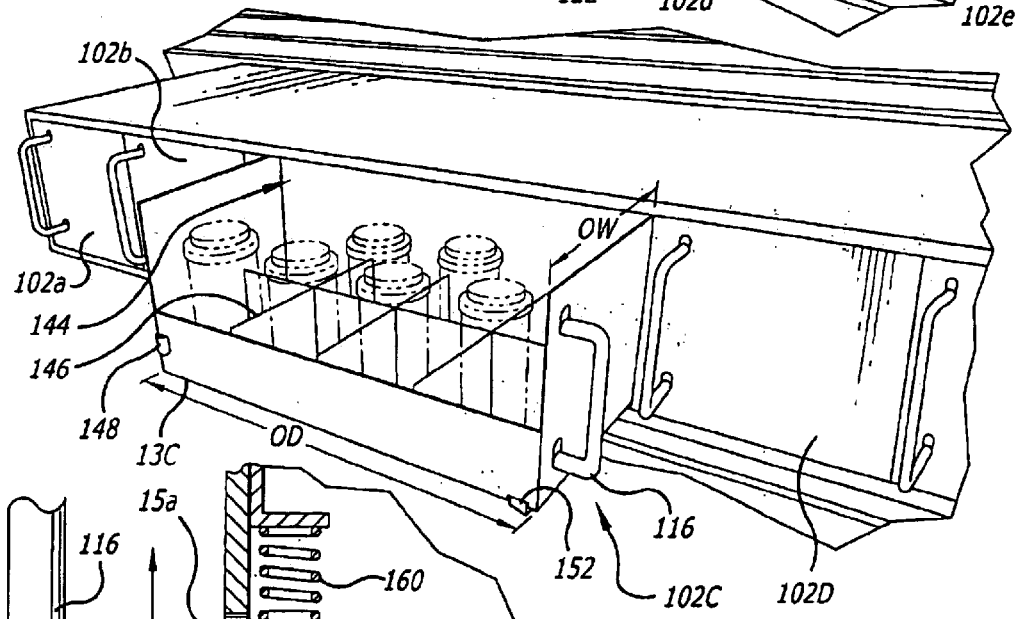
FIG. 19 is a front perspective view of the exemplary embodiment of a sliding and swinging bin storage system of FIG. 18 but with a bin swung open to its opened position and showing items contained therein.

FIG. 19 is a front perspective view of the exemplary embodiment of the sliding and swinging bin storage system of FIG. 18, but with bin 102*c* being swung completely open to its opened position to permit full access to the bin storage space 144 located therein. Optionally, an exemplary bin divider 146 can be placed therein. A number of exemplary containers in phantom are shown stored therein. A push roller 148 located at a push roller corner 150 diagonally opposite the front pivot corner. (See also FIGS. 21 and 24.) In its open position, bin 102*c* largely occupies space 142 formerly located between bins 102*b* and 102*c* of FIG. 18 when bins were all in a closed position. Handle 116 has a track catch 152 extending below a bottom surface 130 of bin.

Figure 20:
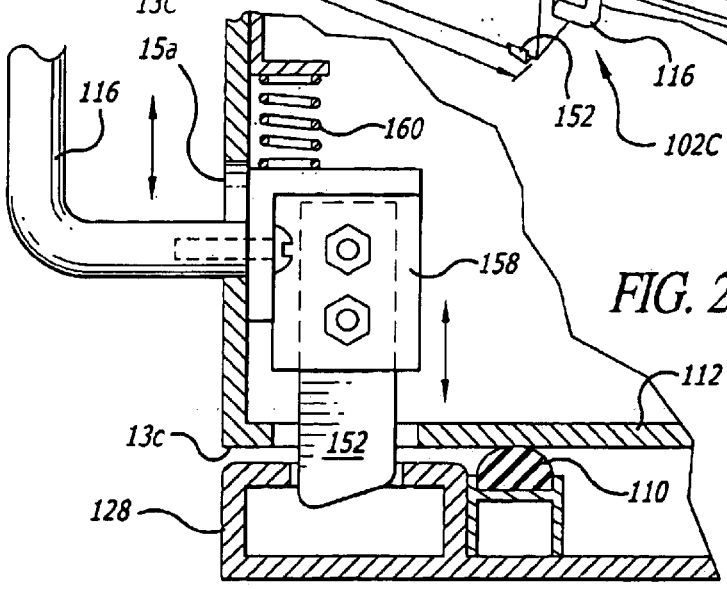
FIG. 20 is a detail showing an exemplary embodiment of a track catch which retains the unpivoted front edge side of the bin slideably retained in a track when a handle is in the closed position.

FIG. 20 is a detail showing an exemplary embodiment of track catch 152 which retains the unpivoted front edge side 154 of the bin slideably retained in a track when handle 116 is in the closed position. Handle 116 passes through a slot 156 in front face of bin 118 and connects to carrier 158 which carries track catch 152. A biasing means such as a spring 160 biases carrier 158 and thus track catch 152 downwardly into lower track 128. Track catch 152 has a shape such that when it is in lower track 128 it will permit a bin to slide side-to-side in the tracks, but will not permit the bin to swing out of the cabinet. By lifting up on handle 116, track catch 152 will be lifted out of lower track 128, and thereby permit bin to be swung out. Thus, when a user wishes to swing open one selected bin in the cabinet, the use will lift up that handle for that bin. For bins not being swung open, their respective track catches will prevent them from being inadvertently swung open. Although shown as engaging with the lower glide track 128, track catch could just as easily be adapted detachably engage with upper glide track 126 (not shown.)

As shown in FIG. 21, if space 142 is not already positioned adjacent to the swinging side of bin, or is not wide enough for the bin to be completely swung open, then push roller 148 of the opening bin 102*c* will push on the pivot side wall 162 of bin 102*b* which is to the side of the swinging bin 102*c*, and/or front pivot corner 124 can push on unpivoted front edge side 154, and thereby create a wide enough space to permit bin 102*c* to be completely opened. Slide surface 108 can comprise low friction material such as nylon upon which bottom surface of bin 130 will slideably rest. The optional slide surface 110 can be located near lower track 128, and can likewise comprise low friction material and support a bottom surface of bin 130 and thereby prevent bin from rubbing on lower track 128 (as shown in FIG. 20.) In the opened position shown in FIG. 18, bin 102*c* will extend out beyond cabinet 104 by about its open depth OD, whereas in their closed position (shown in FIG. 21), bins will remain within cabinet in their open width OW positions. In the design of the storage system, open space 142 should be as wide as the diagonal distance between front pivot corner 124 and push roller corner 150.

FIG. 22 is a partially exposed side view showing bin 102*c* being pivoted out of its cabinet 104. Catch 114 has a downturned end 170 that will make contact with a side 172 of slide surface 110 and thereby act to prevent bin 102*c* from being swung too far out of cabinet 104 (see FIG. 19.) Alternately, if no slide surface 110 is present, catch 114 can make contact with track, and/or catch 114 can be attached to a top edge of back wall of bin and be attached to contact with upper track to prevent bin from being swung out too far.

FIG. 23 is a detail along view lines 23—23 of FIG. 22 of the upper pivot roller 120 of the bin being retained in upper track 126 of its cabinet.

FIG. 25 is another front perspective showing the exemplary sliding and swinging bin storage system 100 of FIG. 18 being supported on the slat wall support system 106, and with a locking access panel 180 placed in the open space of cabinet 104 to prevent bins from being opened.

FIGS. 26 and 27 are views of the exemplary locking access panel 180 used to close the space of the cabinet. It can have feet 182 which are adapted to fit within lower track 128 of cabinet, and a lock 184 with a moving lock lever 186 that is adapted to move up and fit into upper track 126 and thereby fill open space. Other locking systems can be readily used if desired.

Lastly, FIG. 28 is a partial cross-sectional view along view lines 28—28 of FIG. 25 showing an exemplary manner in which the exemplary sliding and swinging bin storage system 100 can be retained on the exemplary slat wall support system 106. For example, brackets 190 and 192 can be located on a back wall 194 of cabinet 104. These brackets 190 and 192 can be adapted to engage with slat grooves 196 in slat back system 106. If desired, only one or the two brackets 190 and 192 can be used, or other systems can be used to retain the sliding and swinging bin storage system 100 on a back wall.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

We claim:

1. A swinging bin storage system, comprising:

a cabinet with an open front; and a plurality of bins located within the cabinet, each bin having a slideable pivot that permits the bin to laterally slide in a direction parallel to the open front within the cabinet and to swing out of the cabinet.

2. The swinging bin storage system of claim 1, wherein the cabinet has an upper track and a lower track parallel and adjacent to its open front, wherein the slideable pivot is laterally slideably and pivotally movable in the upper track and lower track.

3. The swinging bin storage system of claim 2, wherein each bin further comprises a handle on a front wall of the bin, which handle activates a track catch which is adapted to releasably slide within one of the upper and lower tracks of the cabinet and be disengaged therefrom when activated.

4. The swinging bin storage system of claim 2, further comprising a catch located on each bin, which catch will contact at least one of the upper and lower tracks and prevent each bin from being swung out too far from the cabinet.

5. The swinging bin storage system of claim 2, further comprising at least one glide surface on a bottom of the cabinet.

6. The swinging bin storage system of claim 5, further comprising one glide surface on a bottom of the cabinet located adjacent to the lower track.

7. The swinging bin storage system of claim 2, wherein the slideable pivot comprises rollers positioned at an upper and lower end of one front side region of the bins.

8. The swinging bin storage system of claim 7, wherein in use, the rollers are not removed from the upper and lower tracks of the cabinet.

9. The swinging bin storage system of claim 1, further comprising at least one glide surface on a bottom of the cabinet.

10. The swinging bin storage system of claim 9, wherein the glide surface comprises one of low friction material and rolling bearings.

11. The swinging bin storage system of claim 1, wherein each bin comprises a front wall, a back wall, two side walls, and a bottom wall, wherein the side walls have a length that is longer than the width of the front wall, wherein when each bin is in a closed position in the cabinet the front wall of the bins will be generally parallel to the open front of the cabinet, and when each bin is in an opened position, its side walls will be generally parallel to the open front of the cabinet, and a significant portion of open bin will extend outwardly from the open front of the cabinet.

12. The swinging bin storage system of claim 11, further comprising a roller located on a corner of each bin diagonally opposed to a corner of each bin where the slideable pivot is positioned.

13. The swinging bin storage system of claim 11, wherein the plurality of bins are contained in the cabinet, and a width of the open front of the cabinet is wider than the sum of the width of the front walls of the bins to permit bins to be swung out.

14. The swinging bin storage system of claim 1, wherein the cabinet has an attachment mechanism located thereon for supporting the cabinet on a wall.

15. The swinging bin storage system of claim 1, wherein pairs of adjacent bins are hingeably attached together.

16. The swinging bin storage system of claim 1, wherein each bin is hingeably attached to an adjacent bin such that pairs of bins are opened.

17. The swinging bin storage system of claim 1, further comprising a moveable support means on a bottom of each bin.

18. The bin storage system of claim 1, further comprising an access cover panel to close an open space of the cabinet when each of the bins are in a closed position.

19. The swinging bin storage system of claim 1, wherein the cabinet has an attachment mechanism located thereon for supporting the cabinet on a wall.

20. The bin storage system of claim 1, further comprising an access cover panel to close an open space of the cabinet when each of the bins are in a closed position.

21. A swinging bin storage system, comprising:

a cabinet with an open front, with an upper track and a lower track adjacent to its open front; and a plurality of bins located within the cabinet, each bin having a pivot that permits the bin to laterally slide in the upper track and lower track and pivot out of the cabinet when a user wishes to open the cabinet, and a handle on a front wall of the bin, which handle activates a catch which is adapted to releasably slide within one of the upper and lower tracks of the cabinet.

22. The swinging bin storage system of claim 21, further comprising at least one glide surface on a bottom of the cabinet.

23. The swinging bin storage system of claim 21, wherein the slideable pivot comprises rollers positioned at an upper and lower end of one front side region of the bins, which rollers are slideably moveable in the upper and lower tracks, respectively, of the cabinet.

24. The swinging bin storage system of claim 21, wherein each bin comprises a front wall, a back wall, two side walls, and a bottom wall, wherein the side walls have a length that is longer than the width of the front wall, wherein when bins are in a closed position in the cabinet the front wall of the bins will be generally parallel to the open front of the cabinet, and when each bin is in an opened position, its side walls will be parallel to the open front of the cabinet, and a significant portion of open bin will extend outwardly from the open front of the cabinet.

25. The swinging bin storage system of claim 21, further comprising a roller located on corner of bin diagonally opposed to a corner of the bin where the slideable pivot is positioned.

26. The swinging bin storage system of claim 21, wherein the plurality of bins are contained in the cabinet, and a width of the open front of the cabinet is wider than the sum of the width of the front walls of the bins to permit bins to be swung out.

27. A swinging bin storage system, comprising:

a support wall;

a cabinet with an open front and attachment means located on a rear thereof for supporting the cabinet on the support wall; and a plurality of bins located within the cabinet, each bin having a slideable pivot that permit the bin to laterally slide in a direction parallel to the open front within the cabinet and to swing out of the cabinet.

28. The swinging bin storage system of claim 27, wherein a plurality of cabinets and associated plurality of bins are provided.

29. The swinging bin storage system of claim 27, wherein the cabinet has an upper track and a lower track adjacent to its open front, wherein each slideable pivot is slideably and pivotally movable in the upper track and lower track.

30. The swinging bin storage system of claim 27, wherein each bin further comprises a handle on a front wall of the bin, which handle activates a track catch which is adapted to releasably slide within one of the upper and lower tracks of the cabinet and be disengaged therefrom when activated.

31. A swinging bin storage system, comprising:

a cabinet with an open front and an upper track and a lower track adjacent to its open front; and a plurality of bins located within the cabinet, each bin having a slideable pivot that is slideably and pivotally movable in the upper track and lower track and permits the bin to laterally slide within the cabinet and to swing out of the cabinet, wherein each bin further comprises a handle on a front wall of the bin, which handle activates a track catch which is adapted to releasably slide within one of the upper and lower tracks of the cabinet and be disengaged therefrom when activated.

32. A swinging bin storage system, comprising:

a cabinet with an open front; and a plurality of bins located within the cabinet, each bin comprising a front wall, a back wall, two side walls, and a bottom wall, a slideable pivot that permits the bin to laterally slide within the cabinet and to swing out of the cabinet, and a and a roller located on a corner of each bin diagonally opposed to a corner of each bin where the slideable pivot is positioned, wherein the side walls have a length that is longer than the width of the front wall, and wherein when each bin is in a closed position in the cabinet, the front wall of the bins will be generally parallel to the open front of the cabinet, and when each bin is in an opened position, its side walls will be generally parallel to the open front of the cabinet, and a significant portion of open bin will extend outwardly from the open front of the cabinet.

33. The swinging bin storage system of claim 32, wherein the plurality of bins are contained in the cabinet, and a width of the open front of the cabinet is wider than the sum of the width of the front walls of the bins to permit bins to be swung out.

34. A swinging bin storage system, comprising:

a support wall;

a cabinet with an open front and an upper track and a lower track parallel and adjacent to its open front, and attachment mechanism located on a rear thereof for supporting the cabinet on the support wall; and a plurality of bins located within the cabinet portion, each bin having a slideable pivot that permit the bin to laterally slide and pivot within the upper and lower tracks of the cabinet and to swing out of the cabinet and a handle on a front wall of the bin, which handle activates a track catch which is adapted to releasably slide within one of the upper and lower tracks of the cabinet and be disengaged therefrom when activated.

* * * * *